US009108414B1

(12) United States Patent
Fitzsimons et al.

(10) Patent No.: US 9,108,414 B1
(45) Date of Patent: Aug. 18, 2015

(54) WIPER CLEANING FOR PRINTHEADS

(71) Applicants: Sean K. Fitzsimons, Thornton, CO (US); William Edward Manchester, Erie, CO (US); Spencer Robert Wasilewski, Highstown, NJ (US)

(72) Inventors: Sean K. Fitzsimons, Thornton, CO (US); William Edward Manchester, Erie, CO (US); Spencer Robert Wasilewski, Highstown, NJ (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/181,001

(22) Filed: Feb. 14, 2014

(51) Int. Cl.
*B41J 2/165* (2006.01)

(52) U.S. Cl.
CPC ..... *B41J 2/16544* (2013.01); *B41J 2/16538* (2013.01); *B41J 2/1652* (2013.01); *B41J 2/16523* (2013.01); *B41J 2/16532* (2013.01)

(58) Field of Classification Search
CPC ..... B41J 2/16535; B41J 2/16538; B41J 2/16585; B41J 2/16547; B41J 2/16541
See application file for complete search history.

(56) References Cited

U.S. PATENT DOCUMENTS

| | | | | |
|---|---|---|---|---|
| 5,555,461 | A | 9/1996 | Ackerman | |
| 6,183,059 | B1 | 2/2001 | Muhl | |
| 6,347,898 | B1 | 2/2002 | Rhodes | |
| 6,561,619 | B1 | 5/2003 | Shibata | |
| 7,748,823 | B2 | 7/2010 | Hung | |
| 7,758,152 | B2 | 7/2010 | Hibbard | |
| 7,866,810 | B2 | 1/2011 | Campion | |
| 8,186,804 | B2 * | 5/2012 | Muraoka | 347/33 |

FOREIGN PATENT DOCUMENTS

JP 2012035440 A * 2/2012

OTHER PUBLICATIONS

Machine Translation of JP2012035440A, Masaoka, Shingo, Image Forming Apparatus, Feb. 23, 2012, see Entire Document.*
Wikipedia Article: Solvent, Mar. 20, 2015, "Physical Properties of Common Solvents".*

* cited by examiner

*Primary Examiner* — Lisa M Solomon
(74) *Attorney, Agent, or Firm* — Duft Bornsen & Fettig LLP

(57) ABSTRACT

Systems and methods are provided for cleaning wipers for printheads of a printing system. The system includes a cleaning mechanism for a wiper of a printing system. The cleaning mechanism includes a scraper able to scrape ink off of the wiper, and a suction device that is proximate to the scraper and is able to remove the ink from the scraper.

20 Claims, 11 Drawing Sheets

WIPER CLEANING FOR PRINTHEADS

FIELD OF THE INVENTION

The invention relates to the field of printing, and in particular, to printing systems.

BACKGROUND

Inkjet printers are used for a variety of purposes, from desktop to production printing. For example, entities with substantial printing demands typically use an inkjet production printer. An inkjet production printer is a high-speed printer used for volume printing (e.g., one hundred pages per minute or more), and may include continuous-forms printers that print on a web of print media stored on a large roll.

While a continuous-forms inkjet printer operates, the web is quickly passed underneath the nozzles of printheads of the printer, which discharge ink onto the web at intervals to form pixels. Although most of the ink dispensed by the printheads is transferred to the web, some amount of ink remains on the nozzles of the printheads, and this amount may vary depending on the viscosity of the ink used. For example, pigment inks are particularly tacky in comparison to dye inks.

In order to clean the printhead nozzles and ensure that congealed ink does not interfere with the printing process, many inkjet printers include wipers that travel across the printheads and scrape off residual ink before the ink can congeal. However, the wipers themselves accumulate residual ink as they clean the printheads. Congealed ink on a wiper reduces the overall efficacy of that wiper, and can even damage or clog the printheads.

SUMMARY

Embodiments described herein provide wiper cleaning mechanisms that are capable of scraping ink from a wiper for a printhead and utilizing a suction device to vacuum scraped ink off of the wiper. This system, which vacuums and scrapes a wiper for a printhead, ensures that the wiper (and therefore the printhead cleaned by the wiper) remains clean even after long periods of use.

One embodiment is a system that includes a cleaning mechanism for a wiper of a printing system. The cleaning mechanism includes a scraper able to scrape ink off of the wiper, and also includes a suction device that is proximate to the scraper and is able to remove the ink from the scraper.

Another embodiment is a system which includes a wiper that is able to clean a printhead of a printer. The system also includes a scraper and a chamber. The scraper is able to scrape ink off of the wiper. The chamber surrounds the scraper and includes a suction device, proximate to the scraper, that is able to remove ink from the scraper.

Another embodiment is a method. The method includes operating a wiper of a printer to remove ink from a printhead. The method also includes sliding a scraper along the wiper to remove ink from the wiper, and applying suction proximate to the scraper while the scraper slides along the wiper.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
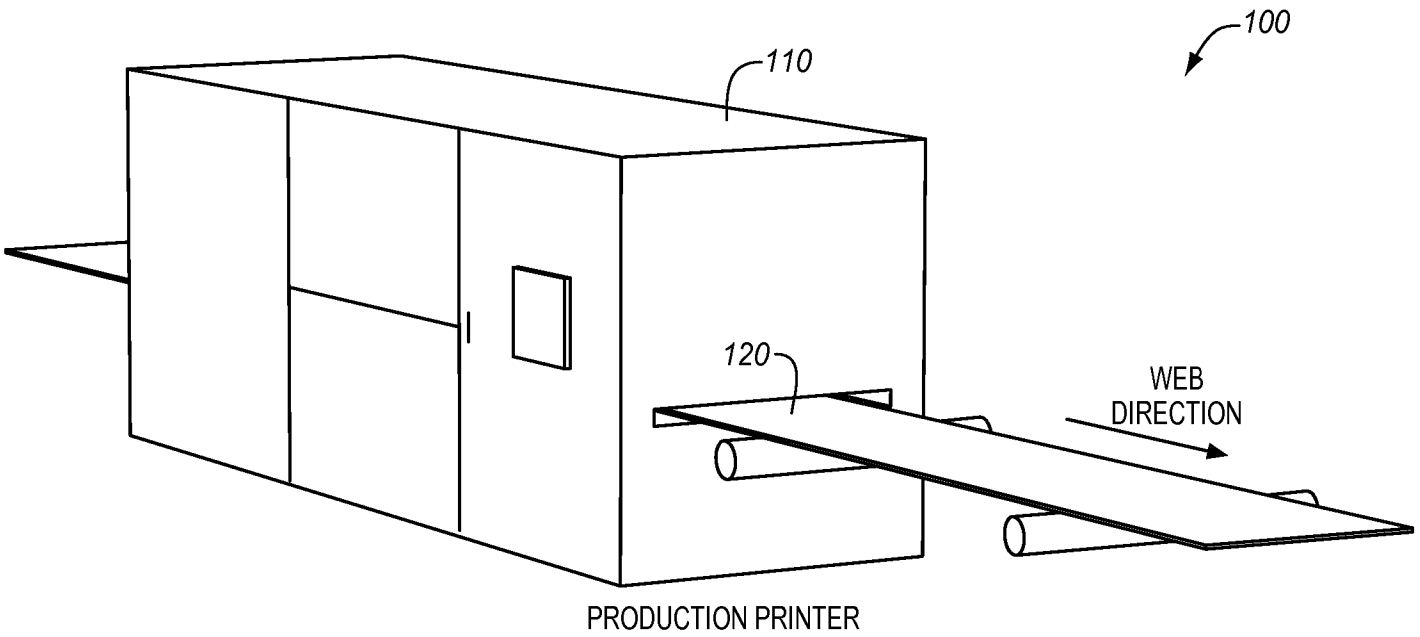
FIG. 1 is a block diagram of a printing system in an exemplary embodiment.

FIG. 1 is a block diagram of a printing system 100 in an exemplary embodiment. Printing system 100 comprises any system, device, or component operable to mark print media (e.g., paper) by applying ink (e.g., pigment inks or dye inks) onto the media. Printing system 100 utilizes one or more wipers to clean its printheads, and printing system 100 includes an enhanced wiper cleaning mechanism which will be discussed in further detail below with respect to FIGS. 6-9. In this embodiment, printing system 100 comprises a continuous-forms printer 110 that marks a web of print media 120.

Figure 2:
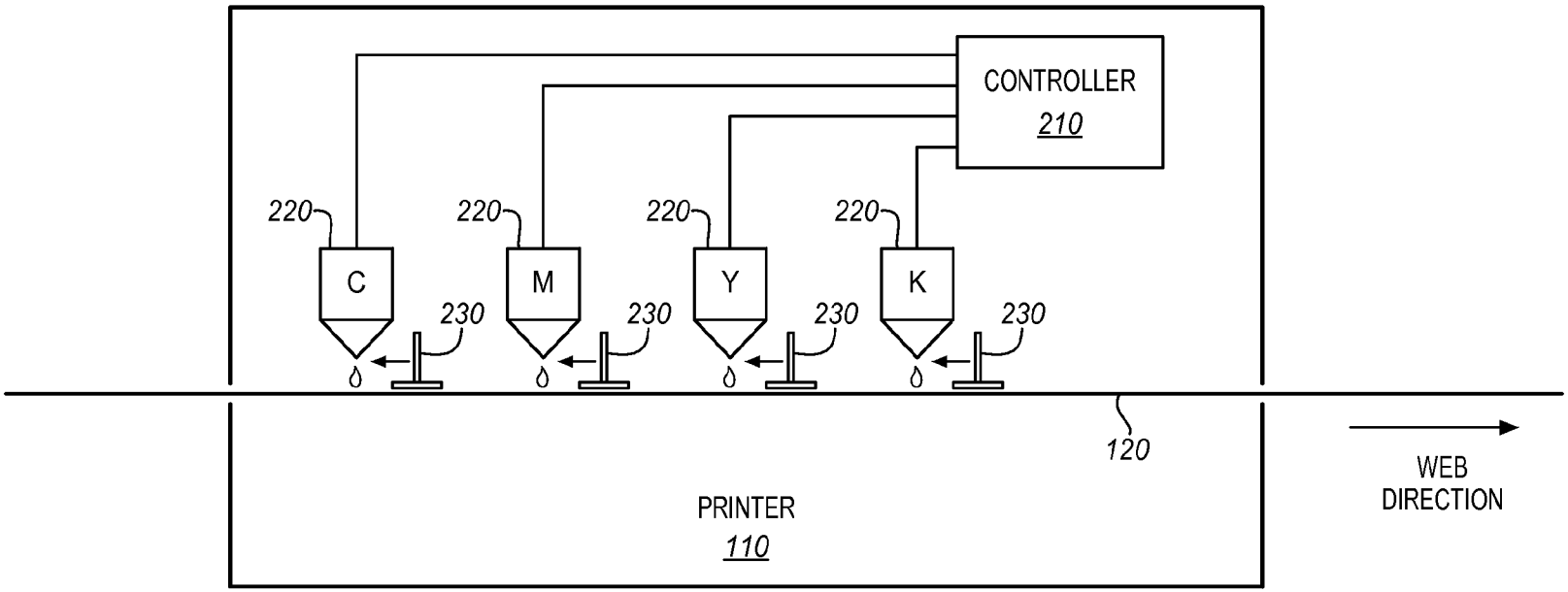
FIG. 2 is a block diagram illustrating an inside view of a printer in an exemplary embodiment.

FIG. 2 is a block diagram illustrating an inside view of printer 110 in an exemplary embodiment. FIG. 2 illustrates, in simplified form, that printer 110 includes multiple printheads 220. As shown in FIG. 2, each printhead 220 is used to dispense a color of ink (e.g., Cyan, Magenta, Yellow, or Key black) onto print media 120. However, in alternate embodiments, each printhead 220 includes nozzles for each of multiple different colors of ink. In further embodiments, printer 110 may utilize entire arrays of printheads 220 to dispense ink.

The operations of printheads 220 are directed by print controller 210. For example, print controller 210 may instruct printheads 220 to mark specific pixel locations on media 120 during printing. Print controller 210 may further operate wipers 230, and any suitable cleaning mechanisms for wipers 230. Printer controller 210 may be implemented, for example, as custom circuitry, as a processor executing programmed instructions stored in an associated program memory, or some combination thereof.

Wipers 230 are used to clean printheads 220. For example, print controller 210 may drive wipers 230 at regular intervals (e.g., after a certain number of pages, at the end of each job, after a specific time interval, after a cleaning or flushing cycle of a printhead 220, etc.) in order to ensure that ink does not congeal onto printheads 220. If viscous inks are used by printheads 220, wipers 230 may be used more often to ensure that no clogging of printhead nozzles occurs. Wipers 230 may be driven across printheads 220 using any suitable drive systems. For example, wipers 230 may be mounted into a track capable of being driven back and forth across printheads 220. In another example, printheads 220 may be driven across one or more stationary wipers 230. Wipers 230 may be made from any suitable material, such as rubberized compounds/materials or other elastic components.

Figure 3:
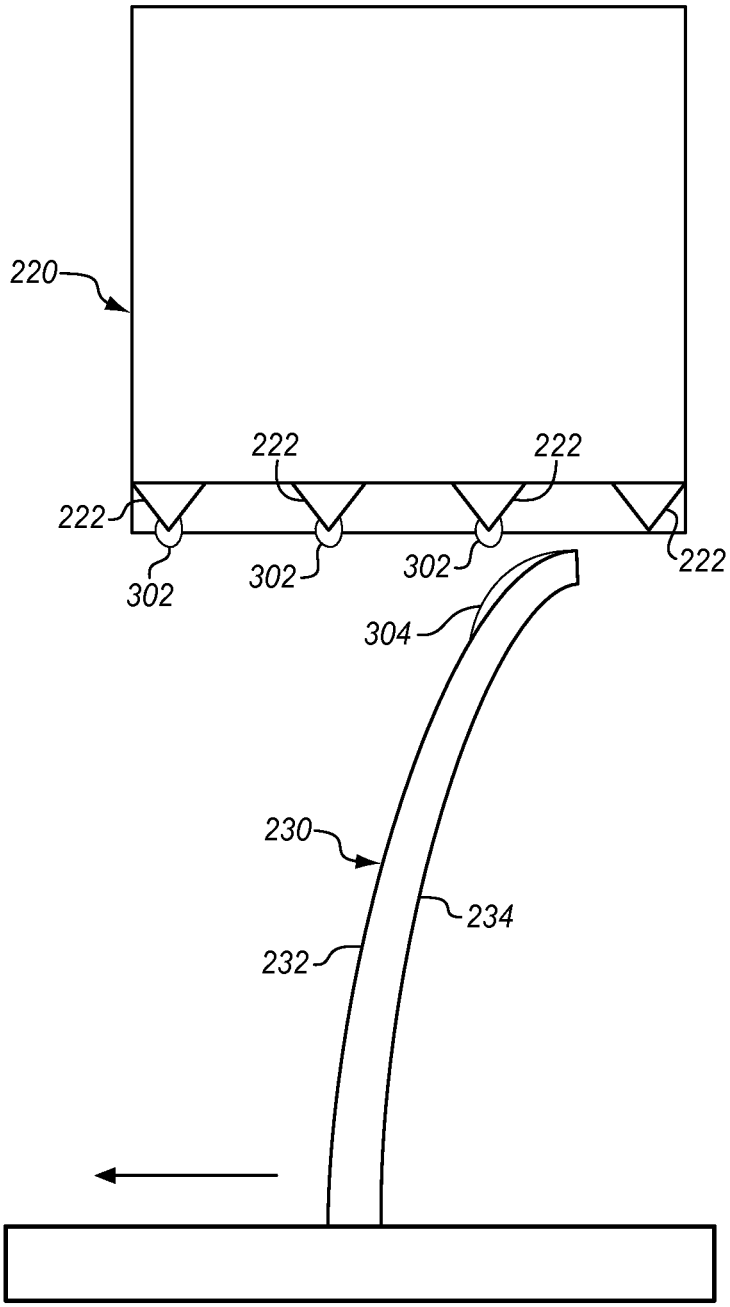
FIG. 3 is a diagram illustrating a wiper that is cleaning a printhead in an exemplary embodiment.
Figure 4:
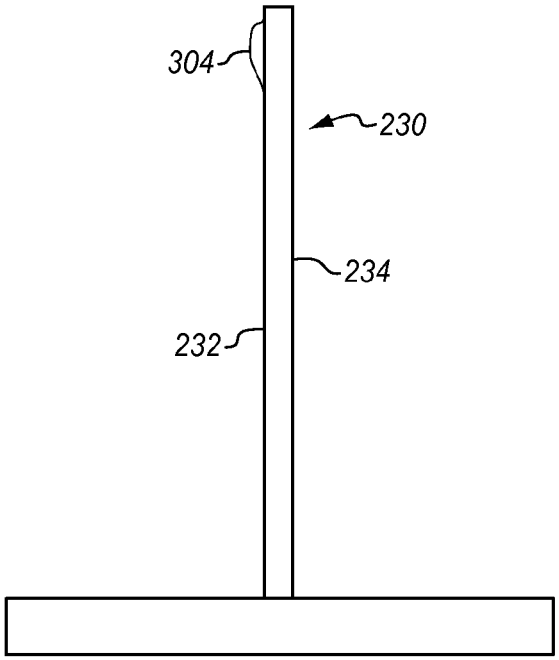
FIGS. 4-5 are side and top views of a wiper that has residual ink in an exemplary embodiment.
Figure 5:
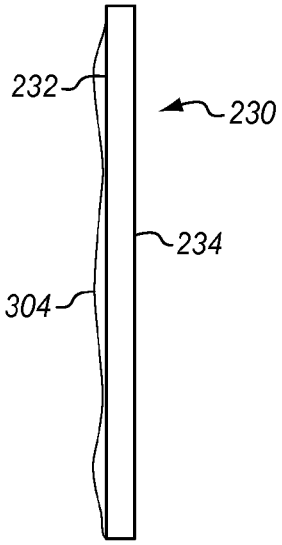

FIG. 3 is a diagram illustrating a wiper that is cleaning a printhead 220 in an exemplary embodiment. According to the embodiment shown in FIG. 3, wiper 230 is an elastic material (e.g., rubber, an elastic polymer, etc.) that is driven across printhead 220 in order to remove residual droplets of ink 302 from each printhead nozzle 222. However, the very act of wiping leaves a residual amount of ink 304 on a front side 232 of wiper 230 (back side 234 of wiper 230 remains substantially clean). If this residual ink 304 is not cleaned off of wiper 230, the ink may congeal onto wiper 230, which in turn hampers the ability of wiper 230 to clean a printhead, and may even damage or clog a printhead 220. FIGS. 4-5 are side and top views of wiper 230 as it retains residual ink 304 in an exemplary embodiment.

To address the issue of ink that congeals onto a wiper, printer 110 includes a wiper cleaning mechanism that is capable of scraping and suctioning residual ink off of wiper 230.

Figure 6:
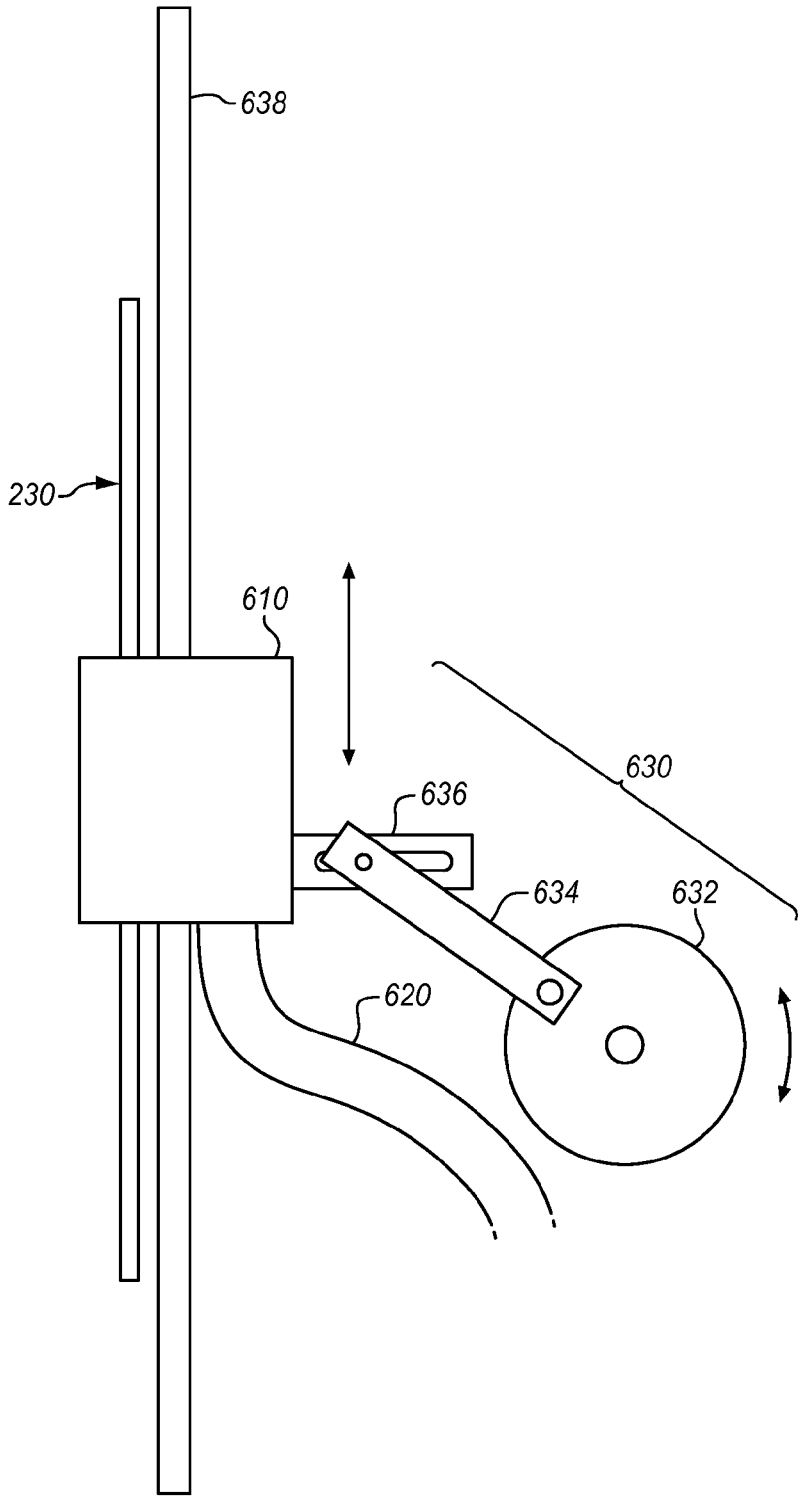
FIG. 6 is a diagram illustrating a top view of a wiper cleaning mechanism in an exemplary embodiment.

FIG. 6 is a diagram illustrating a top view of a wiper cleaning mechanism 610 in an exemplary embodiment. Cleaning mechanism 610 scrapes and suctions ink off of wiper 230 as it slides across wiper 230, ensuring that wiper 230 remains clean and capable of effectively wiping a printhead 220. Cleaning mechanism 610 is coupled to drive system 630, which slides cleaning mechanism 610 back and forth with respect to wiper 230. In this embodiment, drive system 630 includes rotating actuator 632, crossbar 634, and receiver 636, although any suitable combination of drive components may be used. As actuator 632 spins, it drives cleaning mechanism 610 back and forth across wiper 230, and cleaning mechanism 610 scrapes and suctions ink off of wiper 230. Tube 620 draws away ink that has been scraped and suctioned off of wiper 230 by cleaning mechanism 610, sending the ink into a waste receptacle of printer 110.

In this embodiment, an additional support structure 638 (here, an exemplary fixed linear rail) is provided in order to guide cleaning mechanism 610 as it travels back and forth across wiper 230. Support structure 638 and cleaning mechanism 610 may, for example, include any suitable combination of cut-outs and features (not shown) to enable cleaning mechanism 610 to predictably slide across support structure 638.

Figure 7:
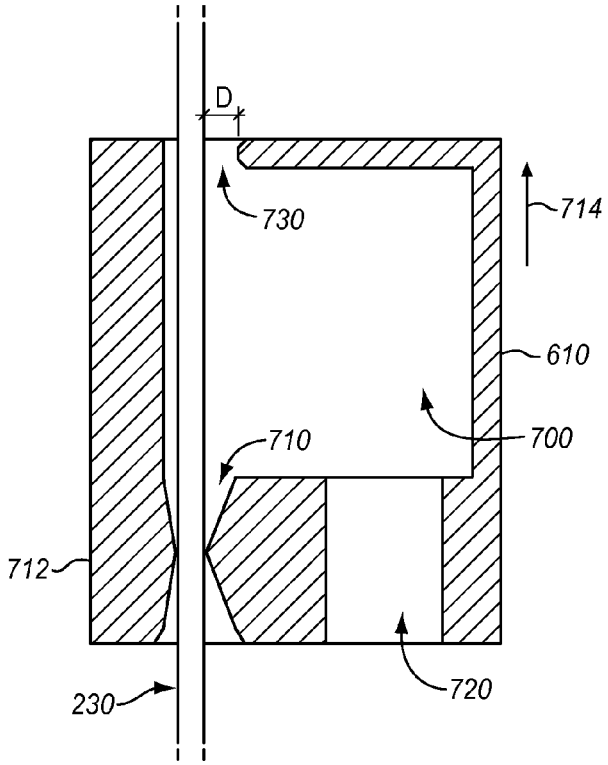
FIGS. 7-9 are additional views of the wiper cleaning mechanism of FIG. 6 in an exemplary embodiment.
Figure 8:
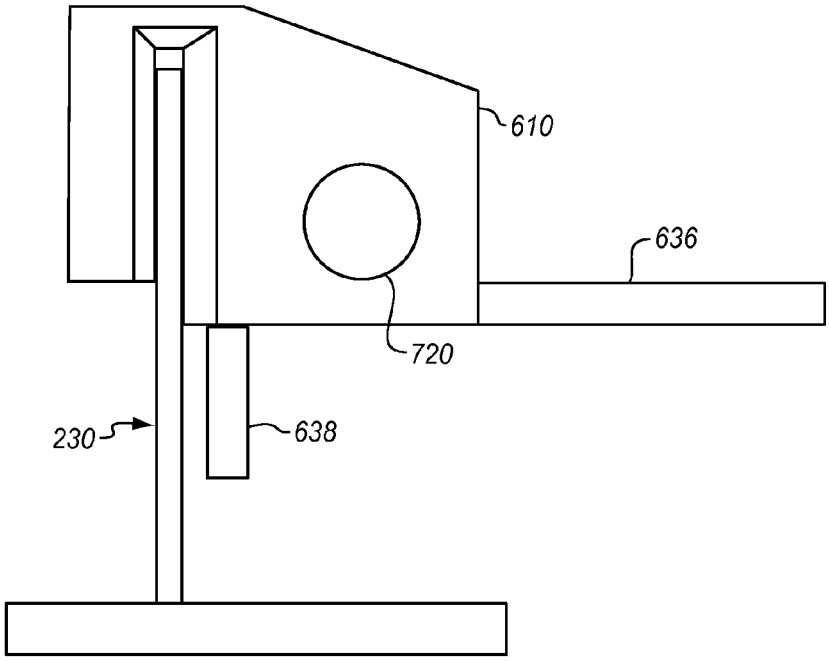
Figure 9:
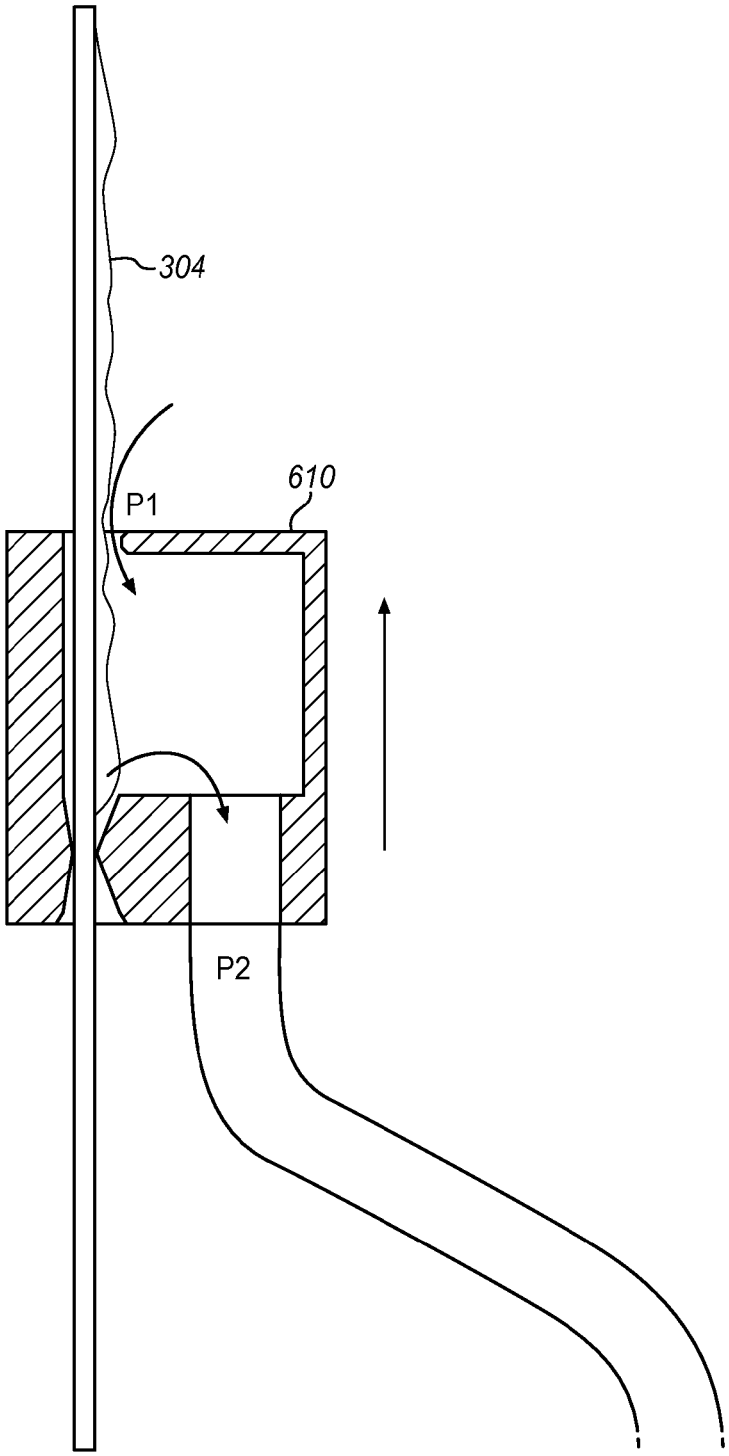

FIGS. 7-9 are additional views of wiper cleaning mechanism 610 that further illustrate the features of cleaning mechanism 610 in an exemplary embodiment. FIG. 7 illustrates a cut-away top view of cleaning mechanism 610 at rest, FIG. 8 illustrates a side view of cleaning mechanism 610 at rest, and FIG. 9 illustrates a cut-away top view of cleaning mechanism 610 as it operates to remove ink from wiper 230.

FIG. 7 illustrates that cleaning mechanism 610 includes a chamber 700 through which wiper 230 slides. On one side of the chamber is an entrance 730 that has a width equal to the width of wiper 230, plus an amount D. For example, D may be between about one quarter and one half of a millimeter. Towards the back of the chamber, a scraper 710 and a backing 712 form an interference fit with wiper 230, which elastically compresses wiper 230 and ensures that ink is scraped off of wiper 230 (and into chamber 700) as cleaning mechanism 610 slides across wiper 230 in the direction indicated by arrow 714. Scraper 710 is encompassed/surrounded by chamber 700. Passage 720 is used to suction scraped ink out of chamber 700 and into tube 620, ensuring that cleaning mechanism 610 will not be clogged.

FIG. 8 shows that cleaning mechanism 610 need not extend to the bottom of wiper 230. In many embodiments, a majority of residual ink will remain near the top of wiper 230. As such, a cleaning mechanism that is shorter than wiper 230 may save space within printer 110 without reducing utility. This reduced footprint for a cleaning mechanism may be particularly beneficial, as free space within a printer is often minimal.

FIG. 8 also illustrates that cleaning mechanism 610 has a closed top (and/or bottom). This top creates a closed environment within chamber 700, which allows for relatively small pressure differentials (of roughly one atmosphere) to cause air to travel through entrance 730 at an accelerated rate. The air traveling through entrance 730 applies momentum to ink on wiper 230, and therefore helps to draw ink into passage 720.

As shown in FIG. 8, in this embodiment cleaning mechanism 610 rests atop structure 638, and the two pieces may include features for slidable mating to allow for structure 638 to guide cleaning mechanism 610 as cleaning mechanism 610 travels back and forth relative to wiper 230. In further embodiments, structure 638 may be attached to one or more elements of drive system 630 in order to guide cleaning mechanism 610. For example, structure 638 may be slidably attached to receiver 636 in some embodiments.

FIG. 9 illustrates how ink is removed from wiper 230 in an exemplary embodiment. As shown in FIG. 9, scraper 710 forces ink off of wiper 230 and into chamber 700. Meanwhile, passage 720 operates as a suction device by applying a low pressure P2 (e.g., half of an atmosphere) to chamber 700. This low pressure at passage 720 draws scraped ink towards passage 720. Furthermore, this low pressure draws air from entrance 730, which is at a higher pressure P1 (e.g., one atmosphere) towards passage 720. Because entrance 730 is relatively small, the air entering chamber 700 travels proximate to the surface of wiper 230 (e.g., at a speed of about one to ten meters per second). This passing air disturbs residual ink on wiper 230 before the residual ink is scraped off, which further enhances the effectiveness of the scraping process. Specifically, the traveling air moves at a sufficiently high velocity to disturb ink drawn off of wiper 230, imparting momentum that draws the ink into passage 720.

Any suitable mechanism may be used to apply a differential pressure between passage 720 and entrance 730. For example, a compressor, pressurized gas source, pump, or other means may be used.

The particular arrangement, number, and configuration of components described herein is exemplary and non-limiting. Illustrative details of the operation of cleaning mechanism 610 will be discussed with regard to FIG. 10. Assume, for this embodiment, that printer 110 has completed printing an incoming job, and that printheads 220 each include residual ink on their respective nozzles.

Figure 10:
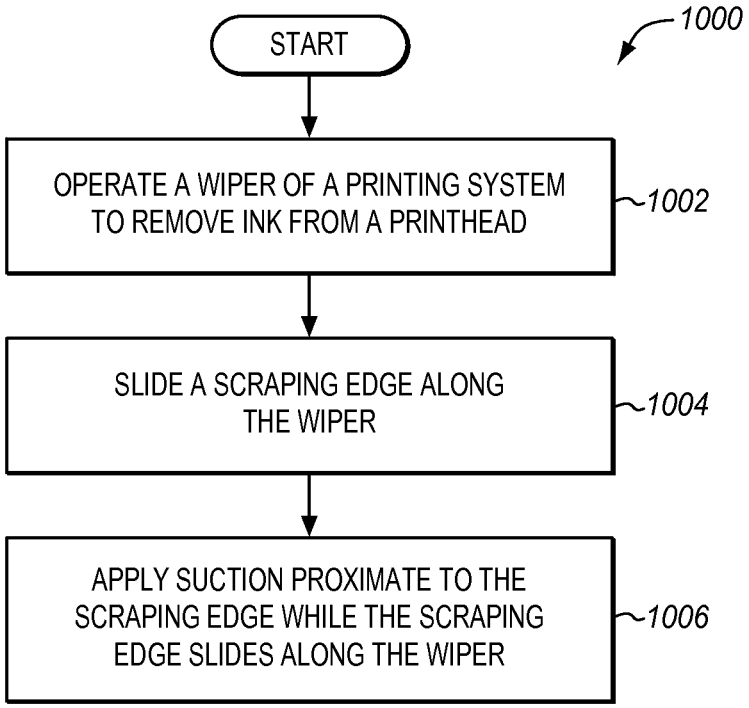
FIG. 10 is a flowchart illustrating a method for operating a wiper cleaning mechanism in an exemplary embodiment.

FIG. 10 is a flowchart illustrating a method 1000 for operating a wiper cleaning mechanism in an exemplary embodiment. The steps of method 1000 are described with reference to printer 110 as shown in FIG. 2, but those skilled in the art will appreciate that method 1000 may be performed in other systems. The steps of the flowcharts described herein are not all inclusive and may include other steps not shown. The steps described herein may also be performed in an alternative order.

In step 1002, print controller 210 instructs an actuator at printer 110 to operate wiper 230 and thereby remove residual ink from nozzles of a printhead 220. Once wiper 230 has been swept across the printhead nozzles, some residual ink remains on wiper 230. If this ink is allowed to remain on wiper 230 it may congeal, which in turn reduces the efficacy of wiper 230, and may even damage a printhead 220, the next time wiper 230 is used to clean the nozzles of the printheads.

In order to clean wiper 230, print controller 210 instructs an actuator to slide cleaning mechanism 610 along wiper 230. Because of its design, cleaning mechanism 610 scrapes residual ink off of wiper 230. During this time, in step 1006, cleaning mechanism 610 also applies differential pressure to passage 720, operating passage 720 as a suction device to draw scraped ink into a receptacle (e.g., a compartment) via tube 620.

Using cleaning mechanism 610 and method 1000, a wiper of a printing system can be cleaned in an effective manner with minimal waste and mess. The scraper and the suction device, when used in combination, ensure that excess ink is properly removed from the wiper and disposed of Thus, the wiper may be used numerous times without congealed ink becoming a concern. This may in turn reduce the interval between manual cleaning and maintenance of the wiper.

Figure 11:
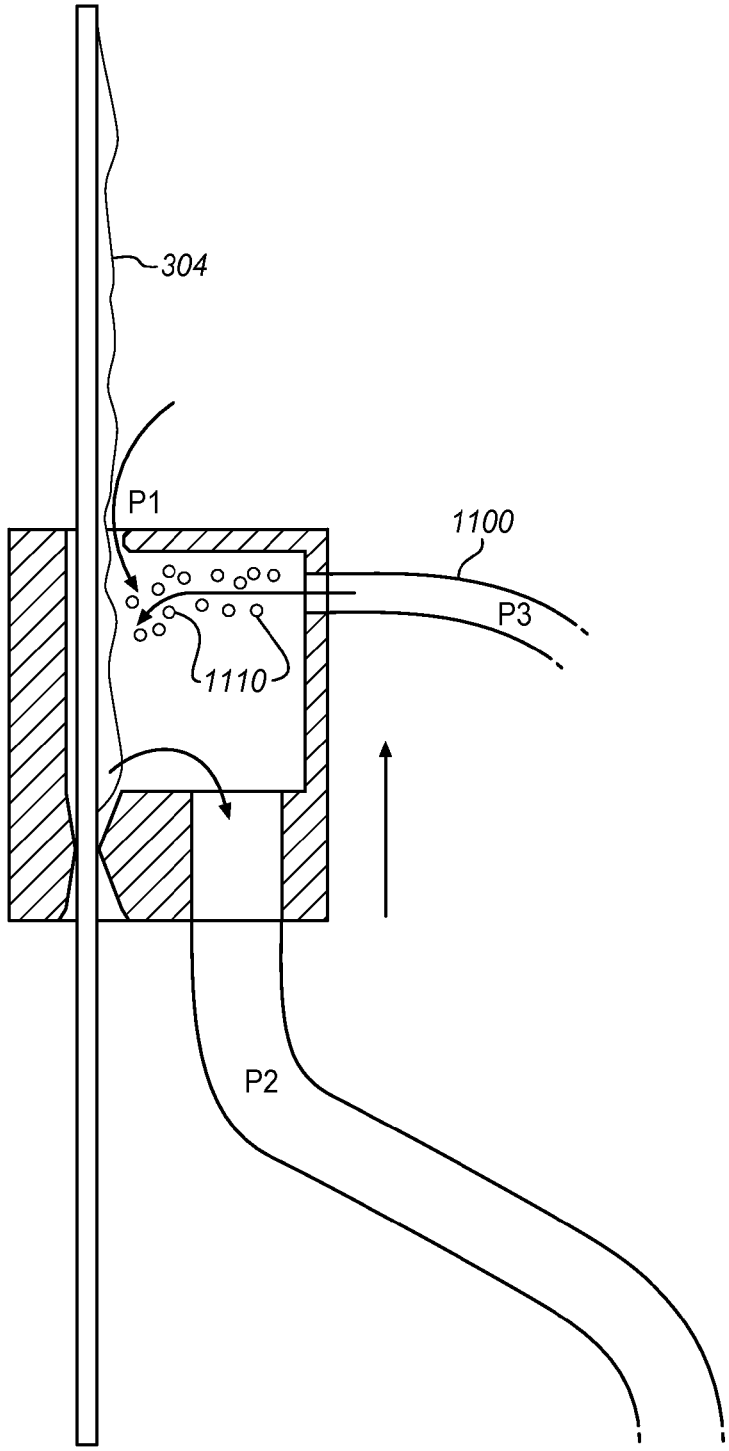
FIG. 11 is a cut-away top view of a wiper cleaning mechanism that includes a dispenser in an exemplary embodiment.

In a further embodiment, cleaning mechanism 610 includes an additional dispenser which is capable of applying a chemical into chamber 700 and onto wiper 230. The chemical may be applied in order to aid in dissolving ink, or otherwise facilitating the ink removal process. For example, the applied chemical may be a surfactant, a solvent, etc. FIG. 11 is a cut-away top view of a wiper cleaning mechanism that includes such a dispenser 1100 that applies a pressure P3 (e.g., a pressure greater than P1 and P2) in order to dispense a chemical 1110 into the chamber an exemplary embodiment.

Figure 12:
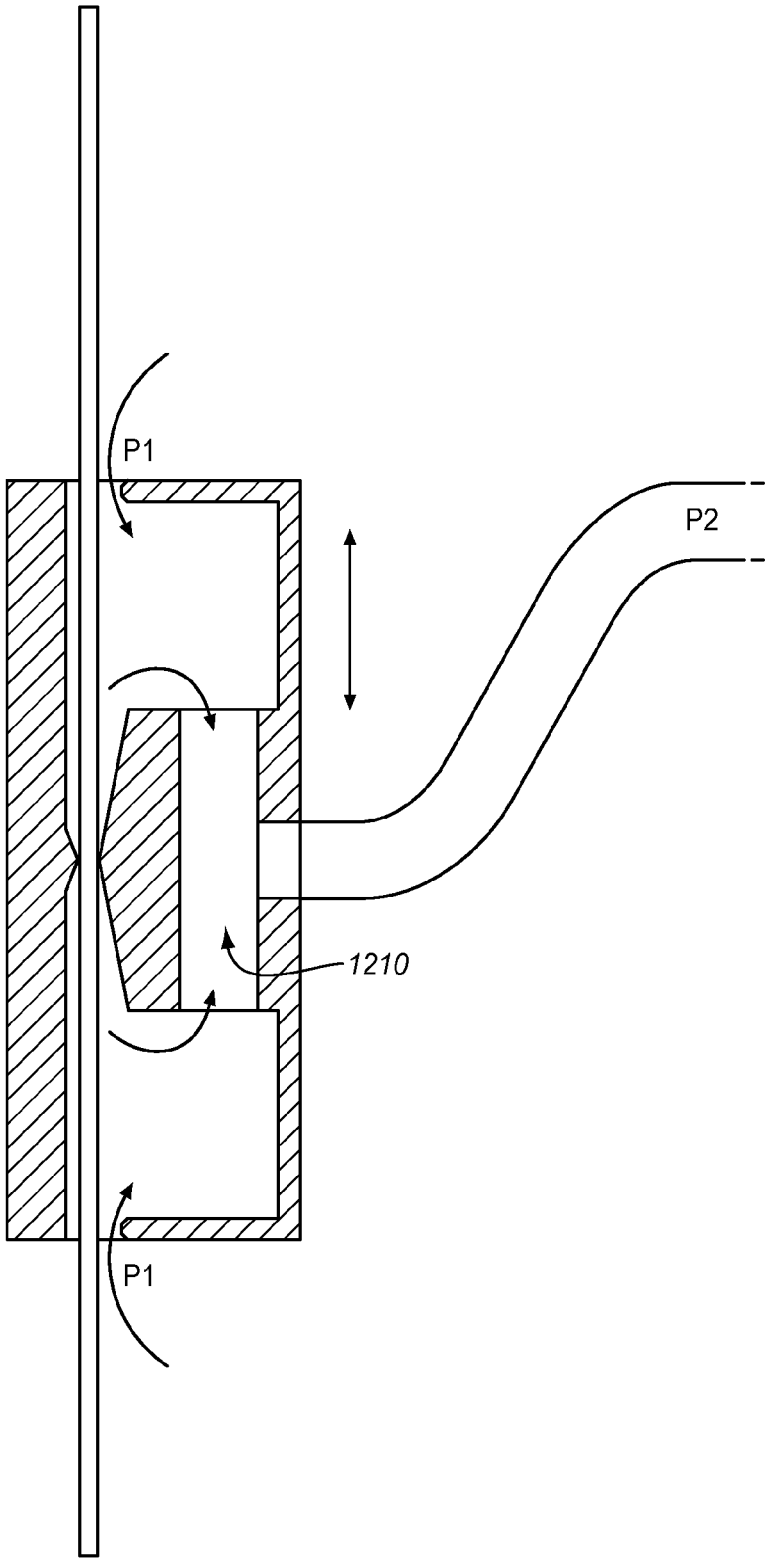
FIG. 12 is a cut-away top view of two-directional wiper cleaning mechanism in an exemplary embodiment

FIG. 12 is a cut-away top view of two-directional wiper cleaning mechanism in an exemplary embodiment. According to FIG. 12, a cleaning mechanism is shown that is effectively a "doubled/mirrored" version of cleaning mechanism 610. In such a cleaning mechanism, residual ink is scraped off of wiper 230 regardless of the direction that the cleaning mechanism is driven in. A passage 1210 allows for ink to be scraped and vacuumed out of both of the chambers.

In a further embodiment, a cleaning mechanism may include a chamber on either side of wiper 230 (e.g., sides 232 and 234 as shown in FIG. 2). Using two separate chambers on either side of wiper 230 can ensure that both sides of wiper 230 are cleaned, if desired.

In an additional further embodiment, cleaning mechanism 610 may remain substantially stationary. In such embodiments, an actuator may be used to drive wiper 230 across cleaning mechanism 610.

Figure 13:
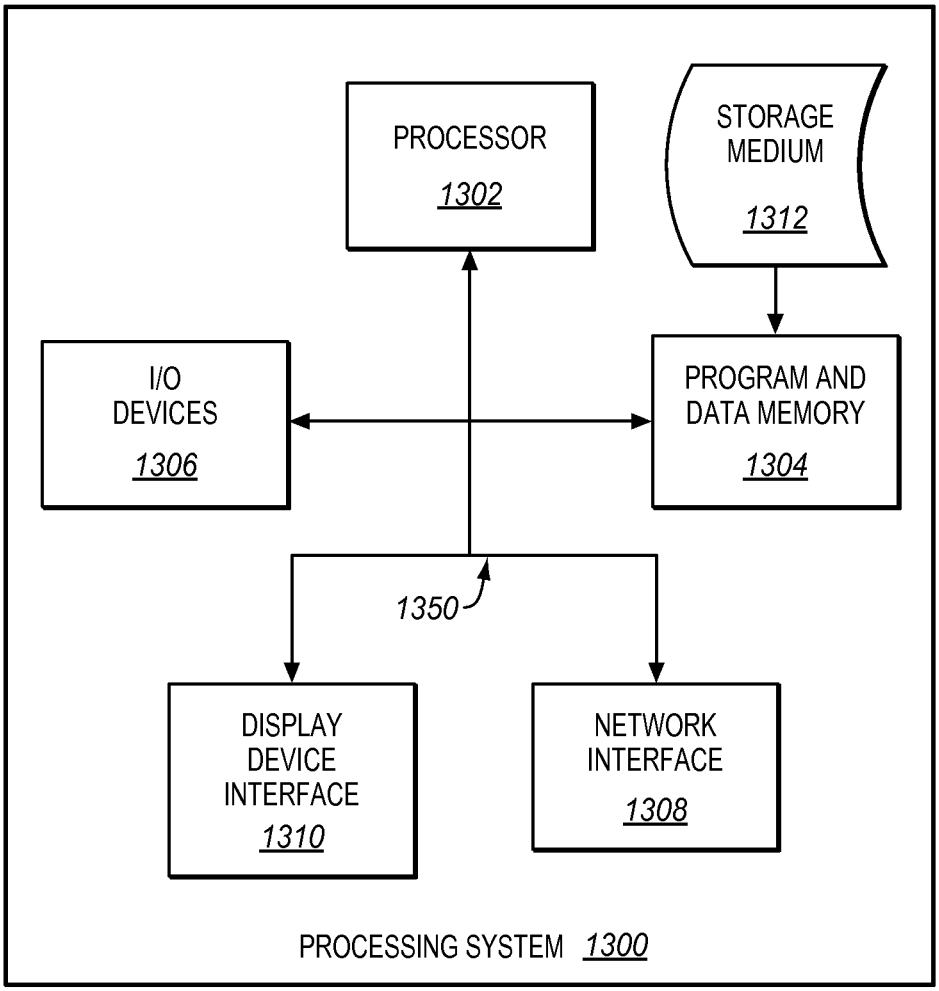
FIG. 13 illustrates a processing system operable to execute a computer readable medium embodying programmed instructions to perform desired functions in an exemplary embodiment.

In one particular embodiment, software is used to direct a processing system of print controller 210 to perform the various operations disclosed herein. FIG. 13 illustrates a processing system 1300 operable to execute a computer readable medium embodying programmed instructions to perform desired functions in an exemplary embodiment. Processing system 1300 is operable to perform the above operations by executing programmed instructions tangibly embodied on computer readable storage medium 1312. In this regard, embodiments of the invention can utilize a computer program accessible via computer-readable medium 1312 providing program code for use by a computer or any other instruction execution system. For the purposes of this description, computer readable storage medium 1312 can be anything that can contain or store the program for use by the computer.

Computer readable storage medium 1312 can be an electronic, magnetic, optical, electromagnetic, infrared, or semiconductor device. Examples of computer readable storage medium 1312 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 1300, being suitable for storing and/or executing the program code, includes at least one processor 1302 coupled to program and data memory 1304 through a system bus 1350. Program and data memory 1304 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 1306 (including but not limited to keyboards, displays, pointing devices, etc.) can be coupled either directly or through intervening I/O controllers. Network adapter interfaces 1308 may also be integrated with the system to enable processing system 1300 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 1310 may be integrated with the system to interface to one or more display devices, such as printing systems and screens for presentation of data generated by processor 1302.

Although specific embodiments were described herein, the scope of the invention is not limited to those specific embodiments. The scope of the invention is defined by the following claims and any equivalents thereof.

We claim:

1. A system comprising:

a cleaning mechanism for a wiper of a printer, the cleaning mechanism comprising:

a scraper configured to scrape ink off of the wiper; and a suction device that is proximate to the scraper and is configured to remove the ink from the scraper by drawing air over a surface of the wiper.

2. The system of claim 1, wherein:

the scraper is configured to compress the wiper to elastically deform the wiper.

3. The system of claim 1, wherein:

the cleaning mechanism comprises an additional scraper and an additional suction device proximate to the additional scraper.

4. The system of claim 1, wherein:

the cleaning mechanism comprises a dispenser configured to apply a solvent to the wiper.

5. The system of claim 1, wherein:

the cleaning mechanism comprises a dispenser configured to apply a surfactant to the wiper.

6. The system of claim 1, comprising:

an actuator configured to slide the cleaning mechanism along the wiper in order to clean the wiper.

7. The system of claim 1, wherein:

the wiper comprises a rubberized material.

8. The system of claim 1, wherein:

the suction device is configured to draw air over the surface of the wiper at a velocity of more than one meter per second.

9. A system comprising:

a wiper configured to clean a printhead of a printer;

a scraper configured to scrape ink off of the wiper; and a chamber that is dimensioned to surround the scraper and includes a suction device, proximate to the scraper, that is configured to remove ink from the scraper by drawing air over a surface of the wiper.

10. The system of claim 9, wherein:

the scraper is configured to compress the wiper to elastically deform the wiper.

11. The system of claim 9, comprising:

an additional scraper and chamber.

12. The system of claim 9, comprising:

a dispenser configured to apply a solvent to the chamber.

13. The system of claim 9, comprising:

a dispenser configured to apply a surfactant to the chamber.

14. The system of claim 9, wherein:

the chamber defines an entrance for the wiper, wherein the width of the entrance minus the width of the wiper is between one quarter of a millimeter and one half of a millimeter.

15. The system of claim 9, comprising:

an actuator configured to move the chamber with respect to the wiper in order to clean the wiper.

16. The system of claim 9, wherein:

the wiper comprises a rubberized material.

17. The system of claim 9, wherein:

the suction device draws air into the chamber at a velocity of more than one meter per second.

18. A method comprising:

operating a wiper of a printer to remove ink from a printhead;

sliding a scraper along the wiper to remove ink from the wiper; and applying suction proximate to the scraper while the scraper slides along the wiper, by drawing air over a surface of the wiper.

19. The method of claim 18, comprising:

dispensing a solvent onto the wiper.

20. The method of claim 18, comprising:

dispensing a surfactant onto the wiper.

* * * * *